US009446420B2

(12) United States Patent
Okui

(10) Patent No.: US 9,446,420 B2
(45) Date of Patent: Sep. 20, 2016

(54) VALVE UNIT AND LIQUID EJECTING APPARATUS

(71) Applicant: Seiko Epson Corporation, Shinjuku-ku (JP)

(72) Inventor: Hiroaki Okui, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/509,991

(22) Filed: Oct. 8, 2014

(65) Prior Publication Data

US 2015/0108257 A1 Apr. 23, 2015

(30) Foreign Application Priority Data

Oct. 17, 2013 (JP) ..... 2013-216734

(51) Int. Cl.
*B41J 2/175* (2006.01)
*B41J 2/17* (2006.01)
*B05B 1/30* (2006.01)

(52) U.S. Cl.
CPC ..... *B05B 1/3013* (2013.01); *B41J 2/17596* (2013.01)

(58) Field of Classification Search
CPC .. B41J 2/175; B41J 2/17513; B41J 2/17523; B41J 2/17556; B41J 2/17596; F16K 7/16; B05B 1/3013
See application file for complete search history.

(56) References Cited

U.S. PATENT DOCUMENTS

2003/0146958 A1 8/2003 Aruga et al.
2006/0108004 A1* 5/2006 Nakamura ..... B41J 2/17596 137/510
2010/0201762 A1* 8/2010 Seino ..... B41J 2/17523 347/86
2011/0199424 A1* 8/2011 Yokouchi ..... B41J 2/16508 347/29
2012/0194608 A1 8/2012 Matsumoto et al.

FOREIGN PATENT DOCUMENTS

JP 2004-142405 A 4/2004
JP 2008-230196 A 10/2008
JP 2012-158002 A 8/2012

* cited by examiner

*Primary Examiner* — Darren W Gorman
(74) *Attorney, Agent, or Firm* — Kilpatrick Townsend & Stockton LLP

(57) ABSTRACT

Provided is a valve unit which opens/closes a flow path and includes a unit-main body having a pressure-adjustment chamber formed therein, a film sealing an opening of the pressure-adjustment chamber, a pressure-receiving plate adhered to the film, a valve body connected to the pressure-receiving plate, and a spring urging the valve body to the film. The pressure-adjustment chamber has an inlet and an outlet through which the liquid flows, a wall portion facing the pressure-receiving plate, and a first-concave portion facing the pressure-receiving plate. The inlet is opened/closed by the valve body and is provided in the first-concave portion. A gap between the wall portion and the pressure-receiving plate is smaller than that between the first-concave portion and the pressure-receiving plate. The wall portion makes the first-concave portion extend from the inlet to a side opposite to the outlet side, with respect to the inlet.

16 Claims, 10 Drawing Sheets

VALVE UNIT AND LIQUID EJECTING APPARATUS

CROSS REFERENCES TO RELATED APPLICATIONS

This application claims priority to Japanese Patent Application No. 2013-216734 filed on Oct. 17, 2013, the entirety of which is hereby incorporated by reference.

BACKGROUND

1. Technical Field

The present invention relates to a valve unit which is provided in the middle of a flow path and opens/closes the flow path and a liquid ejecting apparatus having the valve unit.

2. Related Art

In a liquid ejecting apparatus or the like, a valve unit, such as a self sealing valve, which adjusts a liquid supply pressure in such a manner that the valve unit opens/closes a flow path is provided in the middle of the flow path through which liquid is supplied from a storage unit for storing the liquid to a liquid ejecting head for ejecting the liquid.

In the valve unit, a valve is opened in such a manner that a valve body is opened when a pressure on a downstream side becomes a negative pressure (a negative pressure relative to atmospheric pressure), and thus the liquid is supplied from an upstream side to the downstream side. Specifically, the valve body is provided in a communication hole (an inlet) which causes an accommodation chamber connected to an upstream flow path to communicate with a pressure adjustment chamber connected to a downstream flow path. In addition, a diaphragm is formed on one side surface of the pressure adjustment chamber, using a flexible film. Therefore, when the diaphragm is flexibly deformed in accordance with a pressure difference between a pressure of the liquid in the pressure adjustment chamber and atmospheric pressure, the communication hole (the inlet) is opened/closed by moving the valve body (for example, see JP-A-2008-230196).

However, the liquid which flows into the pressure adjustment chamber through the inlet is likely to flow, with passing through the shortest distance, to the outlet through which the pressure adjustment chamber is connected to the downstream flow path. Thus, in an area apart from a straight line connecting the inlet and outlet, the liquid stagnates, particularly, in a side opposite to the outlet side, on a line connecting the inlet and outlet. As a result, foreign matter, such as dirt and air bubbles, in the liquid or components in the liquid are likely to remain in the area described above.

For this reason, a valve unit in which a liquid flow is switched by modes switchable between a first mode in which a first flow path is formed in a state where a film does not come in contact with a wall portion in the pressure adjustment chamber and a second mode in which a second flow path is formed in a state where the film comes in contact with the wall portion, and thus stagnation of the liquid is suppressed has been proposed (for example, JP-A-2012-158002).

However, when wrinkles are formed on the film, due to heat during a film adhesion, it is difficult to perform a proper film adhesion for satisfying a condition in which there can be switching of modes between the first mode (the first flow path) and the second mode (the second flow path) disclosed in JP-A-2012-158002, when considering the convex and concave shapes of the wrinkles. Therefore, there is a problem in that it is difficult to control a switching operation (switching the abutment state between the film and a wall portion) between the first mode (the first flow path) and the second mode (the second flow path). When the switching operation between the first mode (the first flow path) and the second mode (the second flow path) is not properly performed, there is a concern that a supply pressure adjustment may not be properly performed because, for example, the film abuts on the wall portion during a supply pressure adjustment, and thus a force applied from atmospheric pressure to the film is transmitted to the wall portion and a force applied to a valve is reduced.

The problem described above is not limited to a valve unit intended to be mounted on a liquid ejecting apparatus, represented by an ink jet type recording apparatus, but is shared by a valve unit intended to be mounted on other apparatuses.

SUMMARY

An advantage of some aspects of the invention is to provide a valve unit capable of suppressing stagnation of foreign matter or components in the liquid and a liquid ejecting apparatus.

Aspect 1

According to this aspect of the invention, there is provided a valve unit which opens/closes a flow path and includes a unit main body which has a pressure adjustment chamber formed therein, a film which seals an opening of the pressure adjustment chamber, a pressure receiving plate which is adhered to the film, a valve body which is connected to the pressure receiving plate, and a spring which urges the valve body to the film, in which the pressure adjustment chamber has an inlet through which liquid flows in, an outlet through which the liquid is discharged, a wall portion which is provided in an area facing the pressure receiving plate, and a first concave portion which is provided in an area facing the pressure receiving plate. In addition, the valve body opens/closes the inlet and the inlet is provided in the first concave portion. Furthermore, a gap between the wall portion and the pressure receiving plate in a movement axis direction of the valve body is smaller than a gap between the first concave portion and the pressure receiving plate. When seen in a plan view in the movement axis direction of the valve body, the wall portion is arranged in a state where the first concave portion extends from the inlet to a side opposite to the outlet side, with respect to the inlet.

According to this aspect, the first concave portion is provided. Thus, when the valve is opened, the flow path resistance in a portion extending from the inlet side to a side opposite to the outlet side is set to be smaller than the flow path resistance in a portion extending from the inlet side to the outlet side. As a result, a large amount of the liquid can flow to the side opposite to the outlet side. Therefore, the liquid is stirred over the entirety of the pressure adjustment chamber, and thus it is possible to suppress sedimentation of foreign matter or components in the liquid. In addition, since the pressure receiving plate abuts on the wall portion, it is not necessary to perform adhesion of the film with high precision.

Aspect 2

In the valve unit according to Aspect 1, it is preferable that the pressure adjustment chamber have a second concave portion. In addition, it is preferable that the outlet be provided in the second concave portion and the wall portion be provided in a state where the second concave portion communicates with the first concave portion and extends along an opening edge portion of the pressure adjustment chamber. In this case, since the second concave portion is provided, the liquid can be further stirred in the entirety of the pressure adjustment chamber.

Aspect 3

In the valve unit according to Aspect 1 or 2, it is preferable that, when seen in a plan view in the movement axis direction of the valve body, the first concave portion be provided in a state where an opening width in a direction perpendicular to a straight line passing through the inlet and the outlet is gradually reduced, as moving from the outlet side to the inlet side in the first concave portion. In this case, the flow velocity of a liquid flow is prevented from being reduced in a part of a circumferential edge portion of the pressure adjustment chamber, which is located on a side opposite to the outlet side, with respect to the inlet. As a result, it is possible to suppress sedimentation of foreign matter or components in the liquid.

Aspect 4

In the valve unit according to any one of Aspects 1 to 3, it is preferable that, when seen in a plan view in the movement axis direction of the valve body, the wall portion extend to the outside of the pressure receiving plate. In this case, even when the position of the pressure receiving plate is deviated or the movement axis is inclined, the pressure receiving plate can reliably abut on the wall portion. Furthermore, the first concave portion can extend to the vicinity of a part of the circumferential edge portion of the pressure adjustment chamber, which is located in a side opposite to the outlet side, with respect to the inlet. Accordingly, the liquid is stirred over the entirety of the pressure adjustment chamber, and thus it is possible to suppress sedimentation of foreign matter or components in the liquid.

Aspect 5

In the valve unit according to any one of Aspects 1 to 4, it is preferable that a spring holder be provided in the pressure receiving plate to accommodate one end portion of the spring. In addition, it is preferable that, when the pressure receiving plate does not abut on the wall portion, a gap between the first concave portion and the spring holder in the movement axis direction of the valve body be larger than a gap between the wall portion and the spring holder in a linear direction passing through the inlet and the outlet. In this case, a large amount of liquid which flows into the pressure adjustment chamber through the inlet can flow through the portion between the first concave portion and the pressure receiving plate, which has a relatively small flow path resistance. In addition, since the spring holder is provided, the pressure receiving plate can be stably connected with the spring urging the pressure receiving plate.

Aspect 6

In the valve unit according to any one of Aspects 1 to 5, it is preferable that, when seen in a plan view in the movement axis direction of the valve body, the wall portion have a shape line-symmetric with respect to a straight line, as a symmetry axis, passing through the inlet and the outlet. In this case, substantially the same amount of the liquid can flow to both sides, relative to a straight line, as a center line, passing through the inlet and the outlet, and thus it is possible to further reduce an area in which the liquid stagnates.

Aspect 7

In the valve unit according to any one of Aspects 1 to 6, it is preferable that the film be arranged in a state where a plane direction of the film is parallel to a vertical direction and the outlet be disposed on an upper side of the inlet in the vertical direction. In this case, air bubbles can easily be removed through the outlet. In addition, since the first concave portion is provided, it is possible to prevent foreign matter or components in the liquid from sedimenting in a lower side in the vertical direction.

Aspect 8

According to Aspect 8 of the invention, there is provided a liquid ejecting apparatus which includes the valve unit according to any one of Aspects 1 to 7 and a liquid ejecting head which ejects liquid supplied through the valve unit.

According to Aspect 8, it is possible to obtain a liquid ejecting apparatus in which sedimentation of foreign matter or components in the liquid is suppressed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, details of embodiments of the invention will be described.

Embodiment 1

Figure 1:
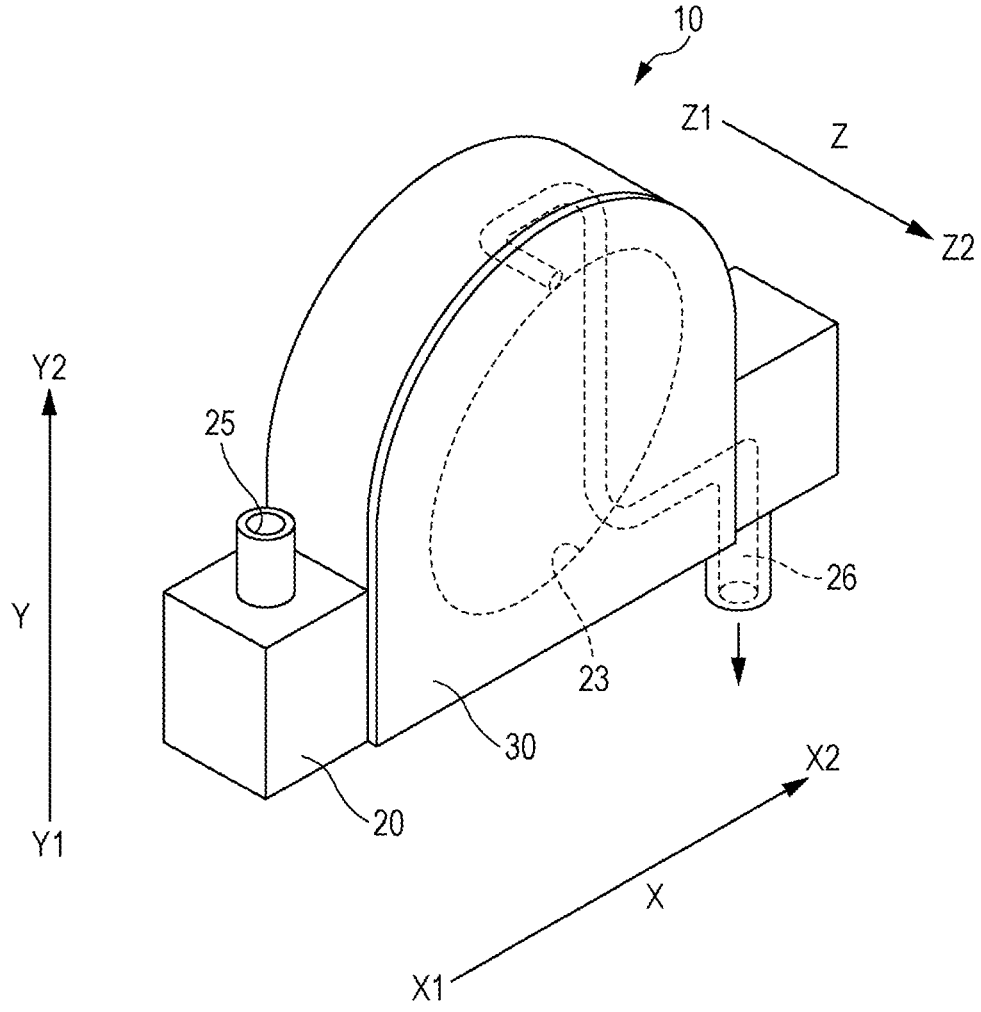
FIG. 1 is a perspective view of a valve unit according to Embodiment 1 of the invention.
Figure 2:
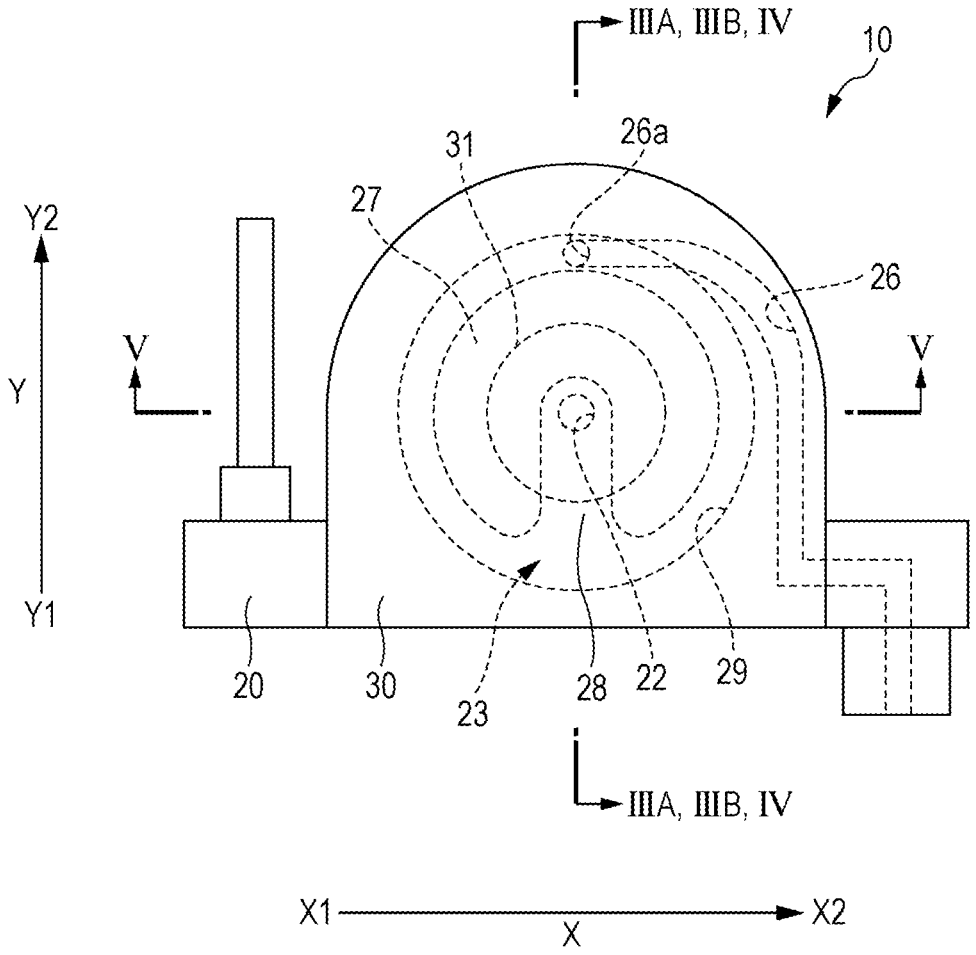
FIG. 2 is a plan view of the valve unit according to Embodiment 1 of the invention.
Figure 3A:
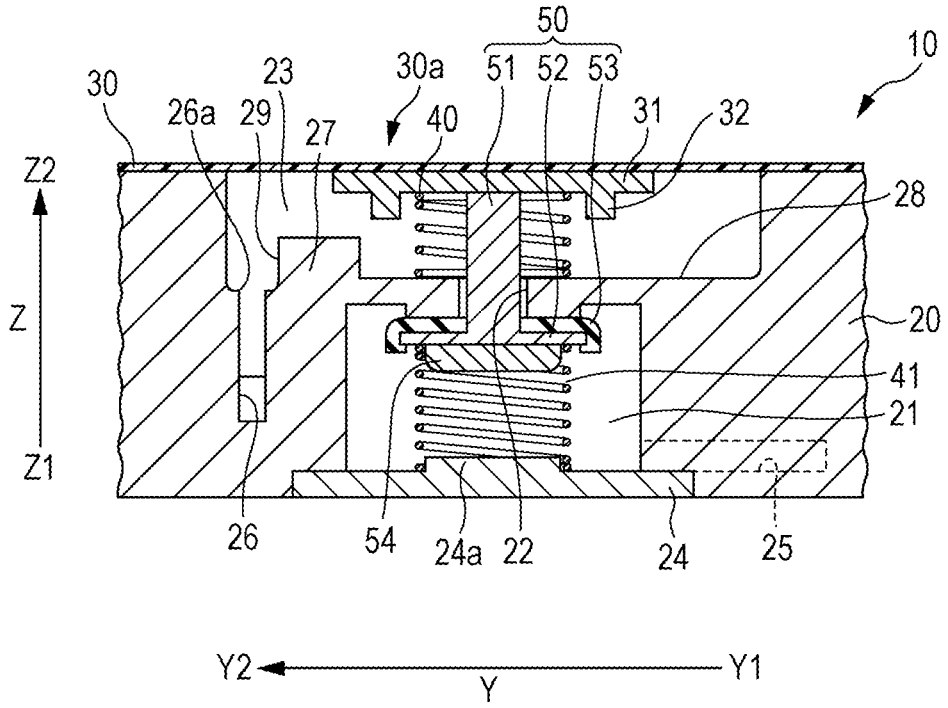
FIGS. 3A and 3B are cross-sectional views of the valve unit according to Embodiment 1 of the invention.
Figure 4:
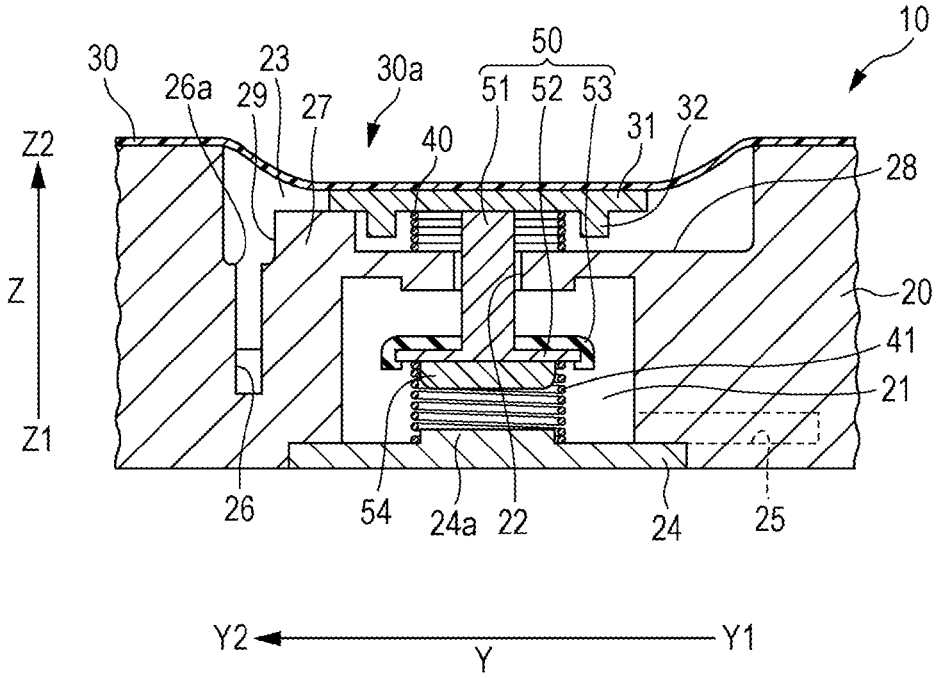
FIG. 4 is a cross-sectional view of the valve unit according to Embodiment 1 of the invention.
Figure 5:
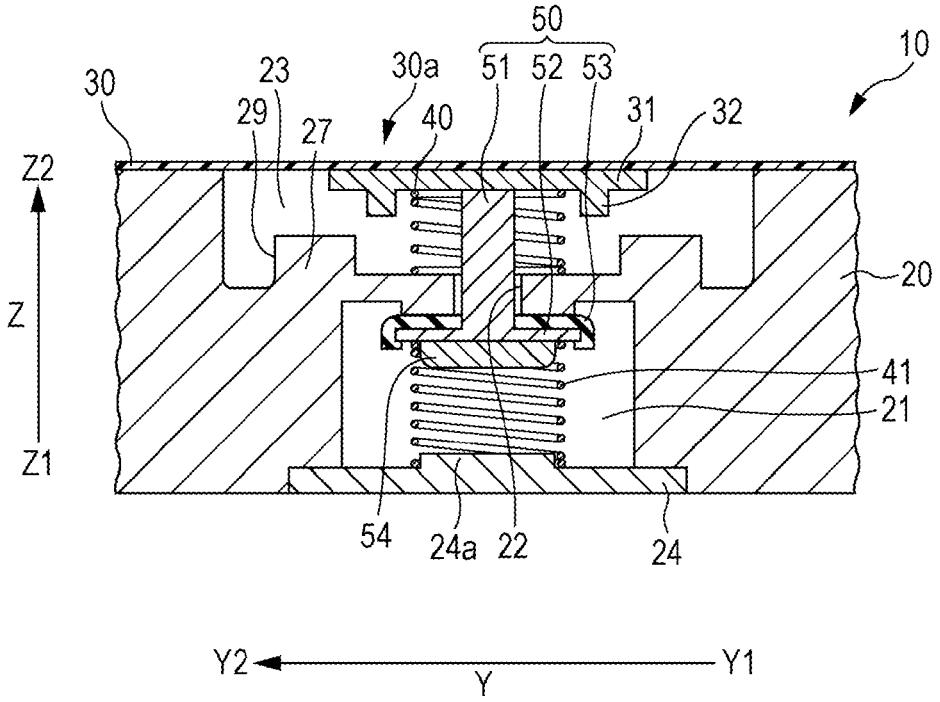
FIG. 5 is a cross-sectional view of the valve unit according to Embodiment 1 of the invention.
Figure 6:
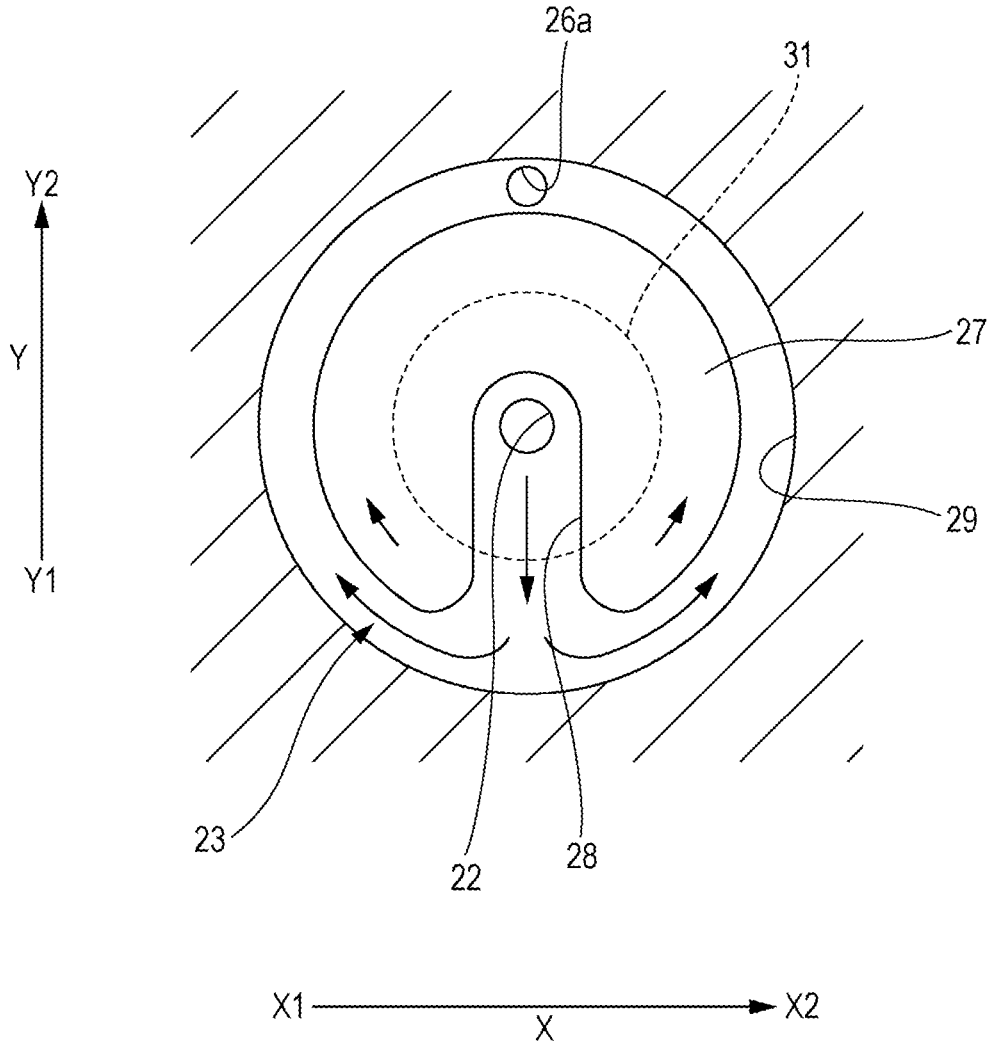
FIG. 6 is a view illustrating a principal portion of the valve unit according to Embodiment 1 of the invention.

FIG. 1 is a perspective view of a valve unit according to Embodiment 1 of the invention and FIG. 2 is a plan view of the valve unit. FIGS. 3A to 4 are cross-sectional views taken along the line IIIA-IIIA, IIIB-IIIB, IV-IV in FIG. 2. FIG. 5 is a cross-sectional view taken along the line V-V in FIG. 2. FIG. 6 is a plan view illustrating a pressure adjustment chamber of the valve unit.

A valve unit 10 is provided in a middle of a flow path through which liquid, such as ink, flows and opens/closes the flow path, as illustrated in the accompanying drawings. In a Z2 side in a Z direction illustrated in the drawings, a film 30 having flexibility adheres, in a thermal welding manner or the like, to one side surface of a unit main body 20 constituting the valve unit 10.

An accommodation chamber 21 which communicates with an upstream side of the flow path and a pressure adjustment chamber 23 which communicates with the accommodation chamber 21 through an inlet 22 and communicates with a downstream side of the flow path are provided in the unit main body 20.

The accommodation chamber 21 is formed in such a manner that, in a Z1 side in the Z direction illustrated in the drawings, a lid member 24 seals a concave portion formed on one side surface of the unit main body 20. In addition, one end of an inflow path 25 is provided to communicate with the accommodation chamber 21. An upstream flow path is connected to the other end of the inflow path 25, through a tube or the like.

In the pressure adjustment chamber 23, an opened concave shape is formed on one side surface which is a surface located on a Z2 side opposite to a side having the accommodation chamber 21, which is in a Z1 side of the unit main body 20. Furthermore, the film 30 is attached to a surface on which the pressure adjustment chamber 23 of the unit main body 20 opens. The opening of the pressure adjustment chamber 23 is sealed with the film 30. An outlet 26*a* as one end of an outflow path 26 communicates with the pressure adjustment chamber 23. A downstream flow path is connected, via, for example, a tube or directly, to the other end of the outflow path 26.

A flexible material having resistance to liquid can be used for the film 30. Furthermore, it is preferable that material having low moisture permeability or low gas permeability relative to liquid oxygen or nitrogen be used for the film 30. Examples of a material forming the film 30 include a high-density polyethylene film and a polypropylene (PP) film on which a nylon film coated with vinylidene chloride (Saran) is laminated in an adhered manner. Other examples of the material forming the film 30 include polyethylene terephthalate (PET). In addition, an adhesion method of the film 30 is not limited to thermal welding. The adhesion may be performed using vibration welding or an adhesive.

A part of a wall surface of the pressure adjustment chamber 23 of the film 30 forms a diaphragm 30*a*. In this embodiment, the pressure adjustment chamber 23 is provided in a state where the opening thereof is formed in a circular shape, and thus the diaphragm 30*a* which seals the opening of the pressure adjustment chamber 23 has a circular shape.

Furthermore, a pressure receiving plate 31 is provided on a surface of the diaphragm 30*a*, which is a surface located on the pressure adjustment chamber 23 side, that is, the Z1 side. The pressure receiving plate 31 has a disk shape of which the outer diameter is smaller than that of the film 30 and adheres to the substantially central position of the Z1 side surface of the diaphragm 30*a*. The adhesion method between the pressure receiving plate 31 and the film 30 is not particularly limited and may include, for example, thermal welding, vibration welding, and adhesion using an adhesive. The pressure receiving plate 31 described above is provided to prevent the valve body which opens or closes the inlet 22 from directly abutting on the film 30. A material, such as resin and metal, of which the hardness is higher than that of the diaphragm 30*a* can be used as the pressure receiving plate 31.

In the pressure receiving plate 31, a spring holder 32 is provided to hold a second spring 40 which is constituted by a coil spring and will be described in detail. The spring holder 32 is provided on a surface on the pressure adjustment chamber 23 side so as to protrude in a disk shape. One end portion of the second spring 40 is accommodated in the spring holder 32.

The inlet 22 is provided on a bottom surface of the pressure adjustment chamber 23, that is, a wall surface facing the diaphragm 30*a* of the unit main body 20. The inlet 22 passes through the wall surface in a thickness direction, that is, the Z direction illustrated in the drawings, and allows the pressure adjustment chamber 23 to communicate with the accommodation chamber 21. This inlet 22 functions as an inflow flow path through which the liquid flows from the accommodation chamber 21 to the pressure adjustment chamber 23. The inlet 22 described above is provided in the substantially central portion of the pressure adjustment chamber 23, that is, being provided in a portion facing the substantially central portion of the pressure receiving plate 31.

A valve body 50 is inserted into the inlet 22. The valve body 50 includes a shaft portion 51 which is inserted into the inlet 22, a flange portion 52, and a sealing member 53 which is fitted to the flange portion 52. The flange portion 52 is provided on an end portion of the shaft portion 51, which is located in the accommodation chamber 21.

The outer diameter of the shaft portion 51 is slightly smaller than that of the inlet 22. One end portion of the shaft portion 51, which is located in the pressure adjustment chamber 23, abuts on the central portion of the pressure receiving plate 31. In addition, the other end portion of the shaft portion 51, which is located on a side opposite to the one end portion abutting on the pressure receiving plate 31, is disposed in the accommodation chamber 21. The flange portion 52 is integrally formed on the other end portion of the shaft portion 51 in the accommodation chamber 21.

The flange portion 52 is constituted by a circular plate member. The sealing member 53 is fitted to the flange portion 52. The sealing member 53 is constituted by rubber, elastomer, or the like and has a dome shape in which a through-hole is formed in a central portion. The sealing member 53 is fitted to the flange portion 52, in a state where the shaft portion 51 is inserted into and passes through the through-hole.

A first spring 41 constituted by a coil spring is interposed between the flange portion 52 of the valve body 50 and the lid member 24 forming the accommodation chamber 21. An urge force of the first spring 41 causes the valve body 50 to be urged to the pressure adjustment chamber 23 side, in a movement axis direction, that is, an axis direction of the shaft portion 51. The first spring 41 is held in such a manner that the first spring 41 is fitted to both a first convex portion 54 and a second convex portion 24*a*. The first convex portion 54 is provided on a surface side opposite to the shaft portion 51 of the flange portion 52. The second convex portion 24*a* is provided on the lid member 24. When the first spring 41 urges the flange portion 52 to the inlet 22 side, the sealing member 53 abuts on an opening edge portion of the inlet 22. Therefore, the inlet 22 is closed, that is, the valve is closed. In this case, the Z direction directed from the Z1 side to the Z2 side is defined as a movement direction of the valve body 50, that is, a movement direction of the shaft portion 51, in which the state of the inlet 22 is switched from an open valve state to a closed valve state.

A second spring 40 constituted by a coil spring is interposed between the pressure receiving plate 31 in the pressure adjustment chamber 23 and a bottom surface of the pressure adjustment chamber 23, which faces the pressure receiving plate 31. The second spring 40 is disposed on an outer circumference of the shaft portion 51 and urges the pressure receiving plate 31 to a side opposite to the bottom surface of the pressure adjustment chamber 23.

In this case, forces applied to the valve body 50 include a reaction force of the film 30, a force which is caused by receiving a liquid pressure of the pressure adjustment chamber 23 and is applied to both the pressure receiving plate 31 and the diaphragm 30*a*, an urge force of the first spring 41 and an urge force of the second spring 40, and a force which is caused by receiving a liquid supply pressure and is applied to the valve body 50.

The reaction force of the film 30 is a force caused when the diaphragm 30*a* in a flexibly deformed state is restored to its initial shape. The larger the deformation amount, that is, a bent amount, of the diaphragm 30*a* is, the greater the reaction force of the film 30 is. Such a reaction force of the film 30 is transmitted to the shaft portion 51, through the pressure receiving plate 31.

The force which is caused by receiving an ink pressure in the pressure adjustment chamber 23 and is applied to both the pressure receiving plate 31 and the diaphragm 30*a* is expressed by the product of the pressure receiving area of both the pressure receiving plate 31 and the diaphragm 30*a*, both of which receive the ink pressure, and the ink pressure. When the liquid in the pressure adjustment chamber 23 flows from the outlet 26*a* to the downstream side, and thus the liquid in the pressure adjustment chamber 23 is reduced, the pressure difference between the liquid pressure and atmospheric pressure increases. Accordingly, the force applied to both the pressure receiving plate 31 and the diaphragm 30*a* increases. The force applied to both the pressure receiving plate 31 and the diaphragm 30*a* functions as a force which is applied, through the shaft portion 51, to the valve body 50 in a valve opening direction.

The urge force of the first spring 41 is a force which urges the valve body 50 in a valve closing direction, that is, a direction directed to the Z2 side. In addition, the urge force of the second spring 40 is a force which presses the pressure receiving plate 31 to the atmosphere side, that is, the Z2 side. In this embodiment, the first spring 41 and the second spring 40 cause the valve body 50 to apply, to the pressure receiving plate 31, a force which is directed in a direction opposite to the direction of the force which is caused by the liquid pressure in the pressure adjustment chamber 23 and applied to both the pressure receiving plate 31 and the diaphragm 30*a*, as described above. Thus, to displace the pressure receiving plate 31 to a position in which the valve body 50 reaches the valve opening position, it is necessary to reduce the liquid pressure in the pressure adjustment chamber 23 to a lower pressure, by as much as the value corresponding to the urge force of both the first spring 41 and the second spring 40 (an operating pressure). In this embodiment, springs for setting an operating pressure are divided into the first spring 41 and the second spring 40 and the respective springs 41 and 40 are accommodated in the accommodation chamber 21 and the pressure adjustment chamber 23, as described above. As a result, it is possible to reduce the thickness of the valve unit 10, compared to a case where a spring is accommodated only one of the accommodation chamber 21 and the pressure adjustment chamber 23.

In the valve unit 10 described above, the liquid in the pressure adjustment chamber 23 flows to the downstream side, and thus the pressure in the pressure adjustment chamber 23 is reduced to a negative pressure lower than atmospheric pressure. Therefore, the diaphragm 30*a* moves to the bottom surface side of the pressure adjustment chamber 23, and thus the pressure receiving plate 31 presses the valve body 50 to the Z1 side, against the urge force of both the first spring 41 and the second spring 40. Accordingly, a gap is caused between the sealing member 53 of the valve body 50 and an opening edge portion of the inlet 22. As a result, the inlet 22 is opened, that is, the valve is opened. Then, when the reduced pressure in the pressure adjustment chamber 23 is recovered by the ink which is supplied, due to the opened valve, from the accommodation chamber 21 to the pressure adjustment chamber 23, the diaphragm 30*a* is moved back to the initial position by the urge force of both the first spring 41 and the second spring 40. As a result, the valve is closed.

In a bottom surface of the pressure adjustment chamber 23 of the valve unit 10, one end of the outflow path 26 through which the liquid in the pressure adjustment chamber 23 flows to a downstream flow path is provided in an opened state. In this embodiment, an opening of the outflow path 26, which opens in the pressure adjustment chamber 23 is referred to as the outlet 26*a*. The outlet 26*a* of this embodiment is provided on one end portion side of the pressure adjustment chamber 23, that is, a Y2 side in the Y direction illustrated in the drawings. In this embodiment, an upper side in a vertical direction is the Y2 side in the Y direction. In other words, the valve unit 10 of this embodiment is disposed in a state where a plane direction of the film 30 includes the Y direction of the vertical direction. The outlet 26*a* is disposed in an end portion of the pressure adjustment chamber 23, which is an end portion located on the upper side in the vertical direction. Therefore, even when air bubbles in the pressure adjustment chamber 23 are moved, by buoyancy, to the upper side in the vertical direction, the air bubbles can reliably be discharged through the outlet 26*a*. In addition, during an initial filling operation in which the pressure adjustment chamber 23 is filled with the liquid for the first time, it is possible to suppress the amount of gas or air bubbles remaining in the pressure adjustment chamber 23, in such a manner that the gas in the pressure adjustment chamber 23 is discharged through the outlet 26*a*. In other words, the initial filling operation can be performed in such a manner that the gas and the liquid are sucked from the outflow path 26 side, in a state where a portion communicating with the inflow path 25 for supplying the liquid to the valve unit 10 is closed (choked). An amount of the gas remaining in the pressure adjustment chamber 23 when the choked state in the initial filling operation is released is determined by the vertical position of the outlet 26*a*. In other words, the closer the outlet 26*a* is located to the upper side in the vertical direction, the more gas remaining in the pressure adjustment chamber can be released in the initial filling operation. In this embodiment, the upper side in the vertical direction is set to the Y2 side in the Y direction. The details of the Y direction will be described below.

Incidentally, when the outlet 26*a* is disposed on a lower side in the vertical direction, the gas remains in a portion located above the outlet 26*a* in the vertical direction in the initial filling operation. The remaining gas does not move downward to the outlet 26*a* because buoyancy is applied to the gas. Therefore, the volume of the pressure adjustment chamber 23, by which the liquid is accommodated, is reduced and behavior of the diaphragm 30*a* is changed. In addition, when the air bubbles remain in the pressure adjustment chamber 23, there is a concern that the air bubbles may flow to the downstream side at an unexpected time and this results in failure. The air bubbles contained in the liquid and the gas passing through the film 30 remain on the upper side in the vertical direction because buoyancy is applied to the air bubbles and the gas. Therefore, the air bubbles grow and it is difficult to discharge the grown air bubbles through the outlet 26*a*. In addition, the air bubbles can be discharged by performing a cleaning operation in which the liquid is sucked, along with the air bubbles, from the outflow path 26 side. However, an amount of liquid consumption for the cleaning operation increases. In this embodiment, the outlet 26*a* is disposed in an end portion of the pressure adjustment chamber 23, which is an end portion located on the upper side in the vertical direction. Therefore, it is possible to suppress the amount of the gas remaining in the initial filling operation. In addition, the air bubbles contained in the liquid in the pressure adjustment chamber 23 and the gas passing through the film 30 are easily discharged through the outlet 26*a*, and thus it is possible to suppress liquid consumption for suppressing growth of the air bubble or the air bubbles remaining. The outlet 26*a* can suppress the gas or the air bubbles remaining as long as the outlet 26*a* is disposed, at least, on the upper side of the inlet 22 in the vertical direction.

In the bottom surface of the pressure adjustment chamber 23, that is, a wall surface facing the diaphragm 30*a*, a wall portion 27 is provided in a state where the wall portion 27 protrudes from the Z1 side to the diaphragm 30*a* side, that is, the Z2 side. The wall portion 27 is provided in a state where a first concave portion 28 and a second concave portion 29 are formed in the pressure adjustment chamber 23. The first concave portion 28 extends, in the Y direction illustrated in the drawings, from an area in which the inlet 22 is formed to a part of a circumferential edge portion of the pressure adjustment chamber 23, which is a circumferential edge portion on the Y1 side opposite to the Y2 side, that is, the outlet 26*a* side. The second concave portion 29 communicates with the first concave portion 28 and continuously extends in a circumferential direction on an outer circumference side of the pressure adjustment chamber 23. In this case, a direction directed from the Y1 side to the Y2 side is set to a direction directed from the inlet 22 to the outlet 26*a*, when seen in a plan view in the Z direction, that is, the Y direction is perpendicular to the Z direction described above.

The first concave portion 28 is formed on a Z1 side bottom surface, in a state where the first concave portion 28 opens to the Z2 side, that is, the diaphragm 30*a* side. In the Z1 side on which the bottom surface is provided, the first concave portion 28 communicates with the inlet 22. In other words, the inlet 22 opens on a part of the bottom surface of the first concave portion 28, which faces the diaphragm 30*a*. In this embodiment, the first concave portion 28 extends from the inlet 22 to the circumferential edge portion on the Y1 side in the Y direction, that is, the first concave portion 28 extends to the lower side in the vertical direction. Furthermore, the first concave portion 28 of this embodiment extends to the lower side in the vertical direction, in a state where the opening width in the X direction illustrated in the drawings is set to be substantially constant. The first concave portion 28 causes a gap between the first concave portion 28 and the pressure receiving plate 31 in the Z direction to be greater than a gap between the wall portion 27 and the pressure receiving plate 31 in the Z direction. Furthermore, the first concave portion 28 has the opening size adequate for allowing the spring holder 32 of the pressure receiving plate 31 to be inserted therein. When the diaphragm 30*a* is flexibly deformed to the bottom surface side of the pressure adjustment chamber 23, the spring holder 32 is inserted to the first concave portion 28. The depth of the first concave portion 28 in the Z direction is set to the value in which, when the pressure receiving plate 31 abuts on the wall portion 27, the spring holder 32 does not abut on the bottom surface of the first concave portion 28, as illustrated in FIG. 4. In this case, the X direction is perpendicular to both the Y direction and the Z direction.

In this case, in the periphery of the inlet 22, when the valve body 50 is opened, a gap $d_1$ between the spring holder 32 of the pressure receiving plate 31 and the first concave portion 28 in the Z direction is greater than a gap $d_2$ between the spring holder 32 of the pressure receiving plate 31 and the wall portion 27 in the Y direction. In other words, when the spring holder 32 is not provided in the pressure receiving plate 31, the first concave portion 28 causes the gap $d_1$ to be reliably greater than the gap $d_2$. On the contrary, when the spring holder 32 is provided in the pressure receiving plate 31, a dimensional relationship between the gap $d_1$ and the gap $d_2$ may be reversed in accordance with the protrusion amount of the spring holder 32, the position of the spring holder 32, or the like. In other words, it is possible to conceive a case where the gap $d_1$ is smaller than the gap $d_2$. As a result, it is necessary to form the spring holder 32 to have a shape in which the position and the protrusion amount of the spring holder 32 are set to satisfy the relationship of $d_1>d_2$.

In other words, the wall portion 27 forming the first concave portion 28 extends, around the shaft portion 51 of the valve body 50, by angles smaller than 360 degrees, when seen in a plan view in the Z direction. It is preferable that the wall portion 27 extend around the shaft portion 51 by angles of 180 degrees or more. Incidentally, when the wall portion 27 extends around the shaft portion 51 by angles smaller than 180 degrees, the wall portion 27 is not provided in an X directional portion of the inlet 22 and the first concave portion 28 is formed in the entirety of a portion located lower than the inlet 22 in the vertical direction. In the first concave portion 28 having a large opening width as described above, a stirring ability for the liquid in the pressure adjustment chamber 23 is deteriorated. This will be described below in detail. In addition, the wall portion 27, the first concave portion 28, and the second concave portion 29 are formed in a shape which is line-symmetric with respect to an axis extending in the Y direction, when seen in a plan view in the Z direction. Therefore, when a liquid flow is formed in the pressure adjustment chamber 23 by both the first concave portion 28 and the second concave portion 29, an area in which the liquid stagnates is reduced. As a result, it is possible to suppress sedimentation of foreign matter or components in the liquid.

The second concave portion 29 continuously extends from the Y1 side end portion of the first concave portion 28 to the outlet 26*a*, along outer circumferences of both sides of the pressure adjustment chamber 23. In other words, the wall portion 27 extends in a state where the wall portion 27 is spaced apart, by a certain distance, from a circumferential edge portion of the pressure adjustment chamber 23. Therefore, the second concave portion 29 of this embodiment is provided on the outer circumferential side of the pressure adjustment chamber 23, in a state where the second concave portion 29 continuously extends, along the circumferential direction, from the lower side to the upper side of the pressure adjustment chamber 23 in the vertical direction. The outlet 26*a* opens on a bottom surface of the second concave portion 29 described above. In this embodiment, the second concave portion 29 extends in the circumferential direction of the pressure adjustment chamber 23, with a substantially constant width. When seen in a plan view in the Z direction, the wall portion 27 which forms, in the pressure adjustment chamber 23, the first concave portion 28 and the second concave portion 29 has a size adequate for allowing the wall portion 27 to extend to the outside of the pressure receiving plate 31. In other words, the wall portion 27 has a size adequate to accommodate the pressure receiving plate 31 when the pressure receiving plate 31 is projected onto the wall portion 27. That is, the outer diameter of the wall portion 27 is greater than that of the pressure receiving plate 31. Therefore, in a case where the pressure receiving plate 31 moves to the wall portion 27 side, that is, the Z1 side in the Z direction, even when the position of the pressure receiving plate 31 is deviated in an XY plane direction of the film 30, the pressure receiving plate 31 can reliably abut on the wall portion 27. Upon comparison with a case where the wall portion 27 does not extend to the outside of the pressure receiving plate 31, in a case where the wall portion 27 extends to the outside of the pressure receiving plate 31, the first concave portion 28 can extend to the vicinity of the Y1 side circumferential edge portion of the pressure adjustment chamber 23. Accordingly, the liquid is stirred over the entirety of the pressure adjustment chamber 23, and thus it is possible to suppress sedimentation of foreign matter or components in the liquid.

The wall portion 27 has a size adequate to extend to the outside of the pressure receiving plate 31, when seen in a plan view in the Z direction, and thus the wall portion 27 includes two portions, one of which is a portion provided in a part of the bottom surface of the pressure adjustment chamber 23, which faces the pressure receiving plate 31, and the other one of which is a portion provided in a part of the bottom surface of the pressure adjustment chamber 23, which does not face the pressure receiving plate 31. Similarly, the first concave portion 28 includes two portions, one of which is a portion provided in a part of the bottom surface of the pressure adjustment chamber 23, which faces the pressure receiving plate 31, and the other one of which is a portion provided in a part of the bottom surface of the pressure adjustment chamber 23, which does not face the pressure receiving plate 31.

A corner portion of the wall portion 27, in which the first concave portion 28 communicates with the second concave portion 29, is chamfered to form a curved surface. Accordingly, when the liquid flows from the first concave portion 28 to the second concave portion 29, foreign matter or the air bubbles are prevented from becoming stuck in the corner portion.

In the valve unit 10 described above, when the liquid in the pressure adjustment chamber 23 flows out through the outlet 26*a* and the pressure in the pressure adjustment chamber 23 is reduced, the diaphragm 30*a* moves to the Z1 side. Therefore, the pressure receiving plate 31 presses the valve body 50 to the Z1 side, against the urge force of both the first spring 41 and the second spring 40, as illustrated in FIGS. 3B and 4.

Figure 3B:
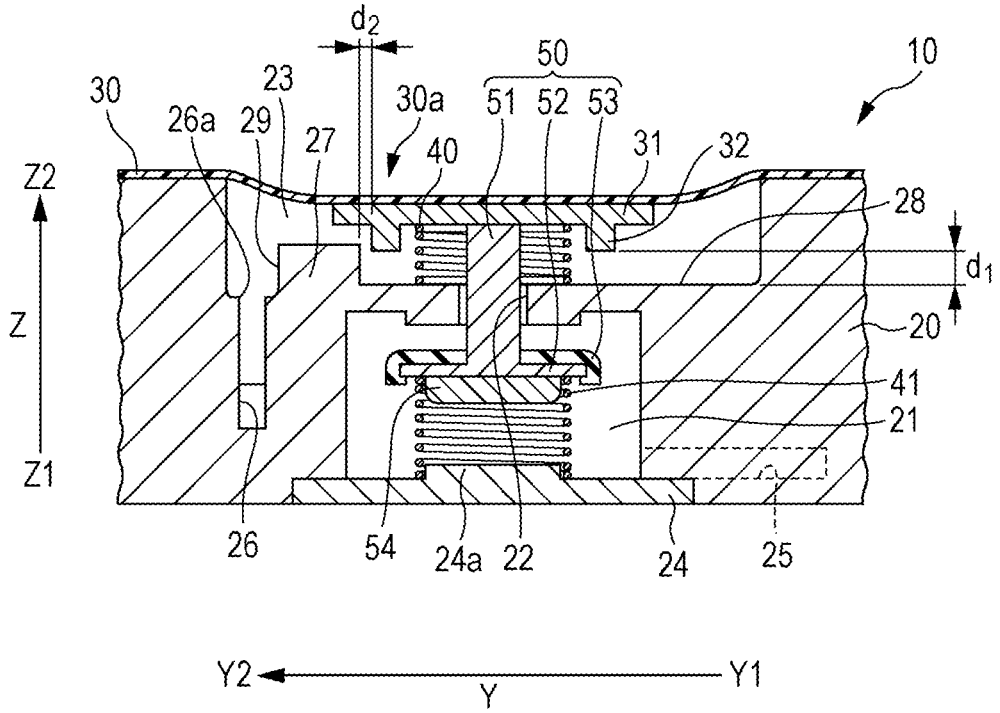

In this case, when the amount of the reduced pressure of the liquid in the pressure adjustment chamber 23 is small (in other words, a difference between atmospheric pressure and the liquid pressure is small), the valve is opened in a state where the pressure receiving plate 31 does not abut on the wall portion 27, as illustrated in FIG. 3B. On the contrary, when the amount of the reduced pressure of the liquid in the pressure adjustment chamber 23 is large, in other words, when a difference between atmospheric pressure and the liquid pressure is large, the pressure receiving plate 31 abuts on the wall portion 27, as illustrated in FIG. 4.

Here, when the pressure receiving plate 31 abuts on the wall portion 27, as illustrated in FIG. 4, a supply flow path which extends from the inlet 22 to the Y1 side is formed in a portion between the pressure receiving plate 31 and the first concave portion 28. The liquid which flows into the pressure adjustment chamber 23 through the inlet 22 passes through the supply flow path formed in a portion between the first concave portion 28 and the pressure receiving plate 31, and then is supplied to a side opposite to the outlet 26*a*, that is, the lower side in the vertical direction in this embodiment.

When the pressure receiving plate 31 does not abut on the wall portion 27, as illustrated in FIG. 3B, in a periphery of the inlet 22, the gap between the pressure receiving plate 31 and the first concave portion 28 in the Z direction is greater than the gap between the pressure receiving plate 31 and the wall portion 27 in the Z direction. Therefore, a flow path resistance of a portion between the first concave portion 28 and the pressure receiving plate 31 is smaller than a flow path resistance in a portion between the pressure receiving plate 31 and the wall portion 27. Accordingly, a relatively large amount of the liquid which flows into the pressure adjustment chamber 23 through the inlet 22 flows through the portion between the first concave portion 28 and the pressure receiving plate 31, because the flow path resistance thereof is smaller than the high flow path resistance of the portion between the pressure receiving plate 31 and the wall portion 27. In other words, the liquid which flows into the pressure adjustment chamber 23 through the inlet 22 flows from the inlet 22 to a side opposite to the outlet 26*a*, that is, the lower side in the vertical direction in this embodiment.

Since the gap $d_2$ between the spring holder 32 and the wall portion 27 in the Y direction is set to be smaller than the gap $d_1$ between the spring holder 32 and the first concave portion 28 in the Z direction, as described above, a relatively large amount of the liquid which flows into the pressure adjustment chamber 23 through the inlet 22 can flow through the portion between the first concave portion 28 and the pressure receiving plate 31, of which the flow path resistance is relatively small.

The liquid which flows into the pressure adjustment chamber 23 through the inlet 22 flows to a side having a relatively low flow path resistance, that is, the liquid flows from the inlet 22 to the Y1 side, as illustrated in FIGS. 3B and 4. Therefore, the liquid flow can be formed over the entirety of the pressure adjustment chamber 23.

Incidentally, when the first concave portion 28 is not formed by the wall portion 27, a relatively large amount of the liquid which flows into the pressure adjustment chamber 23 through the inlet 22 flows along a straight line which directly extends to the outlet 26*a*. Therefore, the liquid flow is not formed on the Y1 side relative to the inlet 22, and thus air bubbles or foreign matter in the liquid, components in the liquid, and the like stagnate in this side. Particularly, when the Y direction is set to be parallel to the vertical direction and the outlet 26*a* is disposed on the upper side in the vertical direction, under the consideration of air-bubble discharge properties, an area in which the liquid stagnates is formed on the lower side in the vertical direction. As a result, large amounts of foreign matter or components in the liquid sediment in a lower side of the pressure adjustment chamber 23 in the vertical direction.

In this embodiment, a supply flow path having a relatively small flow path resistance extends to an area in which foreign matter or components in the liquid in the pressure adjustment chamber 23 are likely to stagnate. Therefore, stagnation of the liquid is suppressed, and thus sedimentation of foreign matter or components in the liquid can be suppressed.

It is preferable that a state where the pressure receiving plate 31 moves to the wall portion 27 to the extent that the pressure receiving plate 31 does not abut on the wall portion 27, as illustrated in FIG. 3B, and a state where the pressure receiving plate 31 abuts on the wall portion 27, as illustrated in FIG. 4, be able to be selectively controlled.

In a case where, for example, a suction operation is performed from the outflow path 26 side, in a state where the portion communicating with the inflow path 25 is closed (choked), as described above, when the pressure receiving plate 31 abuts on the wall portion 27, the liquid flow is formed over the entirety of the pressure adjustment chamber 23, as illustrated in FIG. 4. Therefore, in addition to the gas and the liquid in the pressure adjustment chamber 23, sediment can be effectively discharged through the outlet 26*a*.

Furthermore, in a case where the liquid in the pressure adjustment chamber 23 flows to the downstream side, in a state where the portion communicating with the inflow path 25 is not closed (choked), when the pressure receiving plate 31 moves to the wall portion 27 to the extent that the pressure receiving plate 31 does not abut on the wall portion 27, as illustrated in FIG. 3B, a gap is formed in the portion between the pressure receiving plate 31 and the wall portion 27. Therefore, in addition to the liquid flowing through the supply flow path formed by the first concave portion 28, a very small amount of the liquid can directly flow to the outlet 26*a*. The liquid which flows into the pressure adjustment chamber 23 through the inlet 22 and air bubbles in the liquid can be prevented from stagnating in the vicinity of the wall portion 27.

The liquid flows to the Y1 side due to the first concave portion 28, and then flows from the Y1 side circumferential edge portion of the pressure adjustment chamber 23 to the outlet 26*a*. However, in the gap between the diaphragm 30*a* and the bottom surface of the pressure adjustment chamber 23 in the Z direction, the width of a portion in which the second concave portion 29 is formed is wide and the width of a portion in which the wall portion 27 is provided is narrow. Therefore, the flow path resistance of the second concave portion 29 is smaller than that of the portion in which the wall portion 27 is provided. Thus, a large amount of the liquid flows, in the second concave portion 29, along the circumferential edge portion of the pressure adjustment chamber 23 and flows out through the outlet 26*a*. Incidentally, when seen in a plan view in the Z direction, the second concave portion 29 is disposed in an area in which the second concave portion 29 does not overlap with the pressure receiving plate 31, that is, the second concave portion 29 is disposed outside an area in which the second concave portion 29 faces the pressure receiving plate 31. Therefore, when the diaphragm 30*a* is flexibly deformed to the valve body 50 side and the valve body 50 is opened, the opening of the second concave portion 29 is closed by the diaphragm 30*a*. In addition, as illustrated in FIG. 3B, even when the portion between the diaphragm 30*a* and the wall portion 27 is not completely closed, and thus a gap is formed therebetween, the gap between the second concave portion 29 and the diaphragm 30*a* in the Z direction is adequately larger than the gap between the wall portion 27 and the diaphragm 30*a* in the Z direction.

Accordingly, since the first concave portion 28 prevents a large amount of the liquid from linearly flowing from the inlet 22 directly to the outlet 26*a*, a large amount of the liquid can flow from the inlet 22 to the Y1 side opposite to the outlet 26*a* side. Thus, the liquid flows over the entirety of the pressure adjustment chamber 23, while preventing an area in which the liquid stagnates from being formed in the pressure adjustment chamber 23. As a result, the liquid can be stirred. Therefore, air bubbles or foreign matter, such as dirt, in the liquid, components in the liquid and the like can be prevented from remaining in an area in which the liquid stagnates. In this embodiment, since the second concave portion 29 is provided, a large amount of the liquid which passes through the first concave portion 28 and flows to an area apart from the outlet 26*a* flows in the second concave portion 29 and reaches the outlet 26*a*. As a result, the entirety of the liquid in the pressure adjustment chamber 23 is subjected to stirring, and thus sedimentation or uneven distribution of components of the liquid in the pressure adjustment chamber 23 can be suppressed. Particularly, the valve unit 10 of this embodiment is disposed in a state where the plane direction of the film 30 is parallel to the vertical direction, and thus foreign matter or components in the liquid which flows into the pressure adjustment chamber 23 through the inlet 22 are likely to sediment in the lower side in the vertical direction. In this embodiment, the first concave portion 28 causes the liquid to flow to the lower side in the vertical direction, and thus the liquid flow can be formed in the area on the lower side in the vertical direction, in which foreign matter or components are likely to sediment. Therefore, it is possible to suppress sedimentation of foreign matter or components in the liquid. In this embodiment, the Y direction is set to be parallel to the vertical direction. However, the configuration is not limited thereto and the Z direction may be set to be parallel to the vertical direction. Even in this case, when the first concave portion 28 is not provided, a large amount of the liquid flows along the straight line connecting the inlet 22 and the outlet 26*a*, and thus the amount of the liquid which flows, with the inlet 22 as a center, to the Y1 side opposite to the outlet 26*a* is reduced. However, when the first concave portion 28 and the second concave portion 29 are provided as described in this embodiment, the liquid flow is formed over the entirety of the pressure adjustment chamber 23, and thus the liquid can be stirred. In addition to this configuration, when the outlet 26*a* is located on the upper side of the inlet 22 in the vertical direction, the liquid can be stirred, similarly to the case described above.

In this embodiment, the supply flow path is formed in the portion between the first concave portion 28 and the pressure receiving plate 31, in such a manner that the pressure receiving plate 31 abuts on the wall portion 27, as illustrated in FIG. 4. Thus, it is not necessary to attach the film 30 with high precision, to form the supply flow path. In other words, even when the film 30 is attached to the unit main body 20 with low precision, and thus the film 30 is wrinkled, it is possible to easily form the supply flow path, using the first concave portion 28 and the pressure receiving plate 31, in the following manner. The flow path through which a large amount of the liquid flows from the inlet 22 to the side opposite to the outlet 26*a* side is formed by causing the pressure receiving plate 31 to abut on the wall portion 27.

Figure 7:
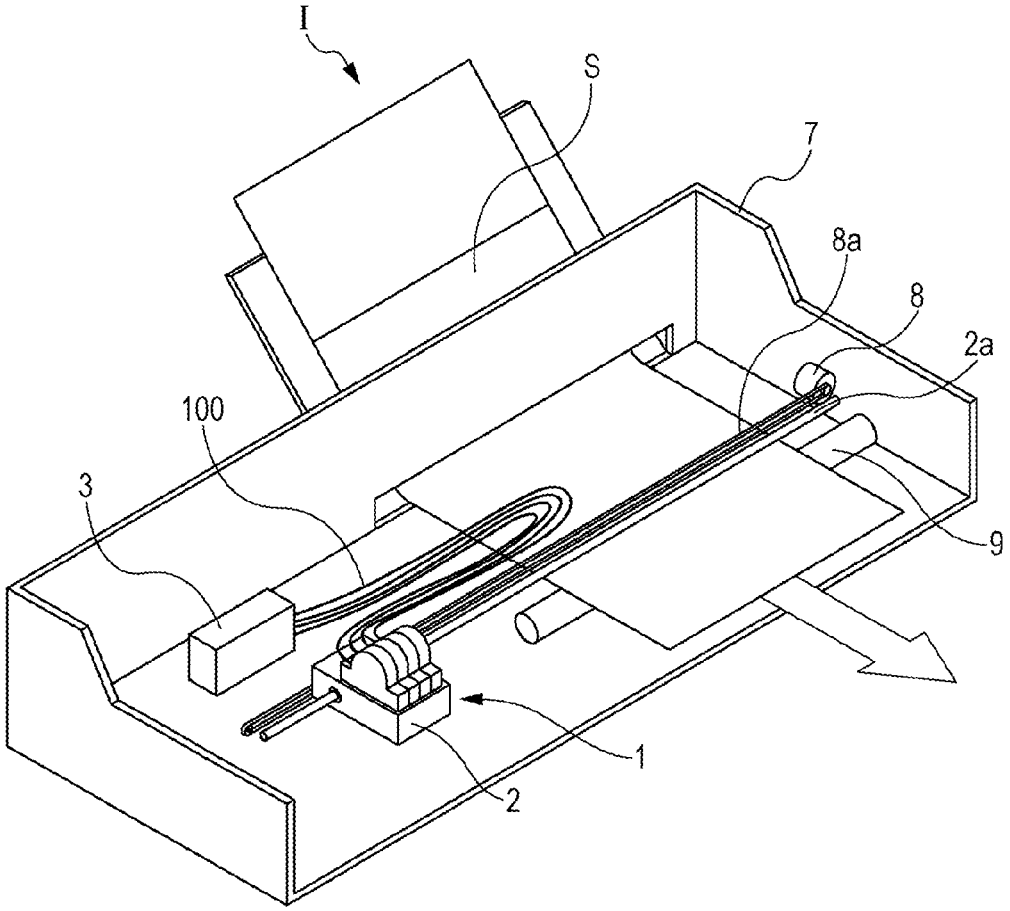
FIG. 7 is a schematic view of a recording apparatus according to Embodiment 1 of the invention.

The valve unit 10 is mounted on a liquid ejecting head which ejects liquid and forms a unit. The unitized valve unit 10 is mounted on a liquid ejecting apparatus. Here, an example of a liquid ejecting apparatus on which a valve unit is mounted will be described with reference to FIG. 7. FIG. 7 is a schematic view illustrating an example of the liquid ejecting apparatus according to Embodiment 1 of the invention.

In a liquid ejecting apparatus I of this embodiment, a liquid ejecting head unit 1 on which a valve unit 10 is mounted is mounted on a carriage 2, as illustrated in FIG. 7. The carriage 2 on which the liquid ejecting head unit 1 is mounted is mounted on a carriage shaft 2*a* installed in a casing body 7, in a state where the carriage 2 can move in a shaft direction.

A storage unit 3 in which liquid is stored is provided in the casing body 7. The liquid from the storage unit 3 is supplied, through tubes 100, to the liquid ejecting head unit 1 mounted on the carriage 2.

A driving force from a driving motor 8 is transmitted to the carriage 2 through a plurality of gears and a timing belt 8*a* (not illustrated), and thus the carriage 2 on which the liquid ejecting head unit 1 is mounted moves along the carriage shaft 2*a*. Meanwhile, a transporting roller 9 is installed in the casing body 7, as a transporting unit, and a recording sheet S which is a recording medium, such as a paper sheet, is transported by the transporting roller 9. A transporting unit for transporting the recording sheet S is not limited to a transporting roller and may be a belt, a drum, or the like.

In the liquid ejecting apparatus I, the carriage 2 moves along the carriage shaft 2*a*. In addition, liquid is discharged, in a liquid-droplet form, through the liquid ejecting head unit 1 and lands on the recording sheet S.

A liquid ejecting apparatus in which the liquid ejecting head unit 1 is mounted on the carriage 2 and moves in a main scanning direction is exemplified as the liquid ejecting apparatus I described above. However, the configuration is not limited thereto. The invention can also be applied to a so-called line type recording apparatus in which the liquid ejecting head unit 1 is fixed to the casing body 7 and a printing operation is performed by simply moving the recording sheet S, such as a paper sheet, in a sub-scanning direction.

In the example described above, the liquid ejecting apparatus I has a configuration in which the storage unit 3 is mounted on the casing body 7. However, the configuration is not limited thereto. For example, liquid may be supplied from the outside of the liquid ejecting apparatus I, without mounting the storage unit 3 on the casing body 7.

Embodiment 2

Figure 8:
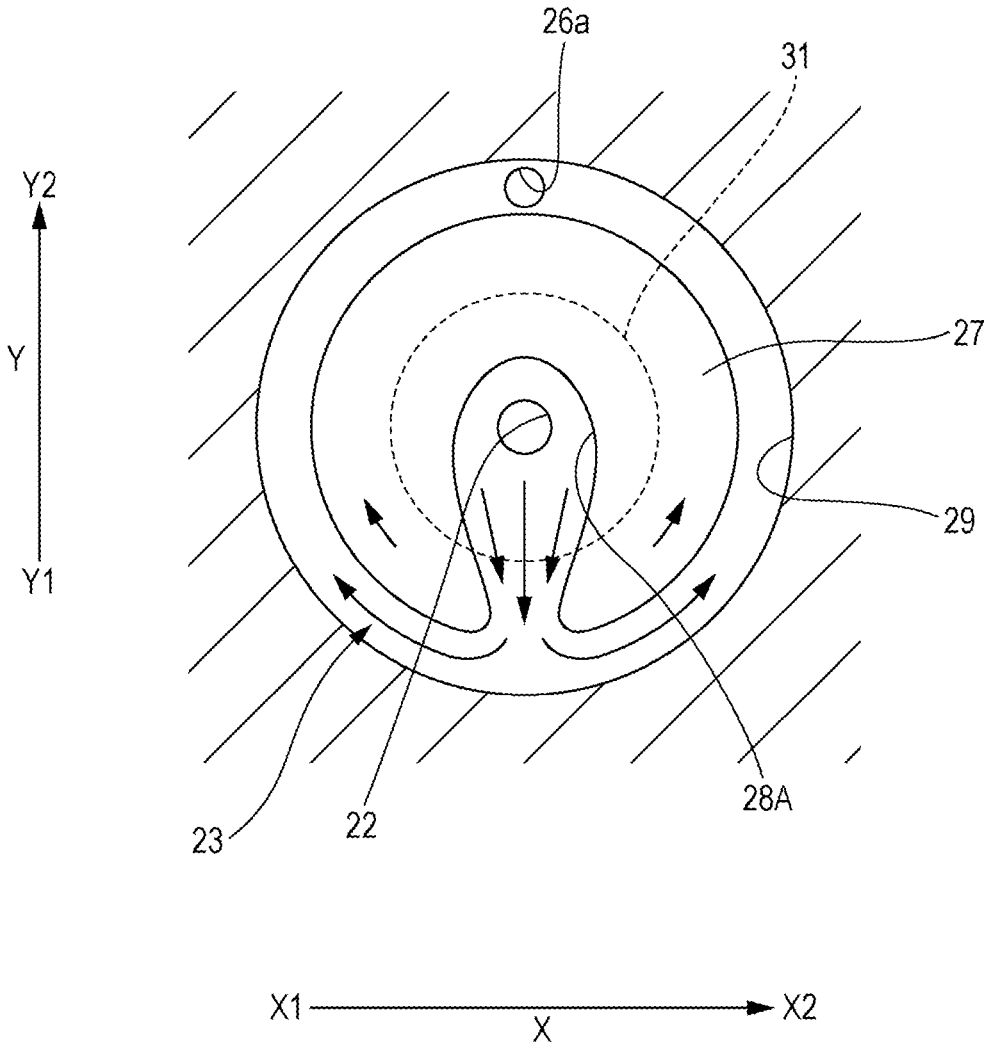
FIG. 8 is a view illustrating a principal portion of a valve unit according to Embodiment 2 of the invention.

FIG. 8 is a plan view illustrating a pressure adjustment chamber of a valve unit according to Embodiment 2 of the invention. The same reference numerals are given to components having the same configuration as those in Embodiment 1. The descriptions thereof will not be repeated.

The wall portion 27 is provided in the pressure adjustment chamber 23 formed in the valve unit 10 of this embodiment, as illustrated in FIG. 8. A first concave portion 28A and the second concave portion 29 are formed by the wall portion 27.

In this case, the first concave portion 28A extends from the inlet 22 to a part of the circumferential edge portion of the pressure adjustment chamber 23, which is located on the Y1 side opposite to the outlet 26*a*. The opening width of the first concave portion 28A in the X direction is gradually reduced, as moving away from the inlet 22 in the first concave portion 28A. In other words, a lateral surface forming the first concave portion 28A is an inclined surface which is inclined with respect to the vertical direction. In other words, when seen in a plan view in the Z direction, that is, a movement axis direction of the valve body 50, the first concave portion 28A is formed in a shape in which the opening width in the X direction, that is, a direction perpendicular to a straight line passing through the inlet 22 and the outlet 26*a*, is gradually reduced, as moving from the outlet 26*a* side to the inlet 22 side in the first concave portion 28A, that is, from the Y2 side to the Y1 side.

Since the opening width of the first concave portion 28A is gradually reduced, as moving to the Y1 side in the first concave portion 28A, a flow velocity improves in a position apart from the inlet 22 in the Y direction. Therefore, it is possible to suppress sedimentation of foreign matter or components in the liquid. Incidentally, when, for example, the width of the first concave portion 28A is constant in the Y direction, the liquid diffuses to both sides of the Y1 side circumferential edge portion of the pressure adjustment chamber 23, that is, both the X1 side and the X2 side of the second concave portion 29. As a result, there is a concern that the flow velocity of the liquid flow may be reduced in the Y1 side circumferential edge portion of the pressure adjustment chamber 23, and thus the liquid may stagnate. In this embodiment, since the opening width of the first concave portion 28A is gradually reduced, as moving to the Y1 side in the first concave portion 28A, the flow velocity of the liquid flow is prevented from being reduced in the Y1 side circumferential edge portion of the pressure adjustment chamber 23. As a result, it is possible to suppress sedimentation of foreign matter or components in the liquid.

Embodiment 3

Figure 9:
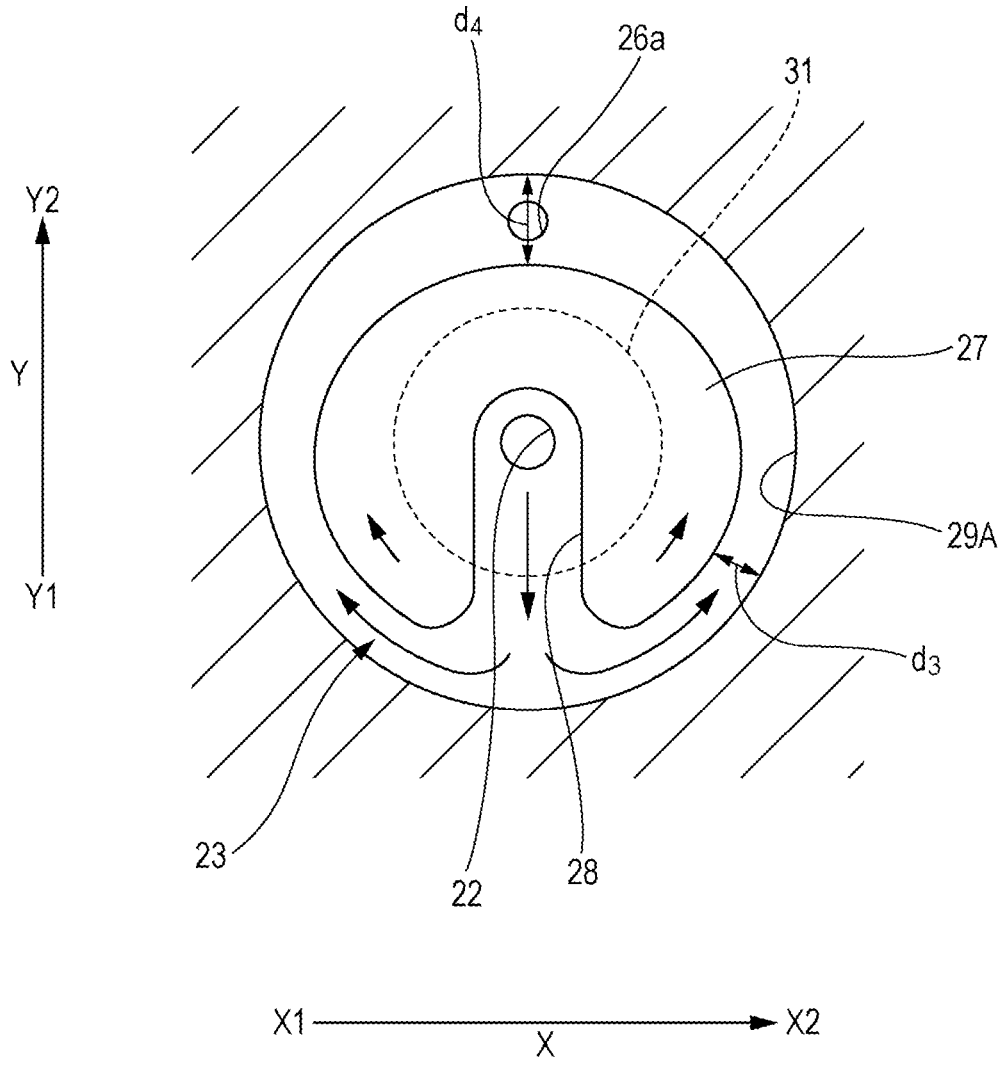
FIG. 9 is a view illustrating a principal portion of a valve unit according to Embodiment 3 of the invention.

FIG. 9 is a plan view illustrating a pressure adjustment chamber of a valve unit according to Embodiment 3 of the invention. The same reference numerals are given to components having the same configuration as those in Embodiment 1. The descriptions thereof will not be repeated.

The wall portion 27 is provided in the pressure adjustment chamber 23 formed in the valve unit 10 of this embodiment, as illustrated in FIG. 9. The first concave portion 28 and a second concave portion 29A are formed by the wall portion 27.

In the second concave portion 29A, a width $d_4$ of an area communicating with the outlet 26*a*, that is, an area on the Y2 side, is larger than an X directional width $d_3$ of an area communicating with the first concave portion 28, that is, an area on the Y1 side. The width of the second concave portion 29A referred to in this case is a Y2 side opening width of the second concave portion 29A in the Y direction, that is, a width in a direction perpendicular to a flowing direction of the liquid flow flowing through the second concave portion 29A. In other words, the width of the second concave portion 29A referred to in this case is a width in which a line passing through the inlet 22 crosses the second concave portion 29A.

In this embodiment, the width of the second concave portion 29A gradually increases along the liquid flow flowing through the second concave portion 29A, that is, along the circumferential direction of the pressure adjustment chamber 23, as the second concave portion 29A moves from the Y1 side to the Y2 side.

Since the width of the second concave portion 29A gradually increases, as moving to the outlet 26*a* in the second concave portion 29A, the flow path resistance of the liquid flowing through the second concave portion 29A can be reduced in the vicinity of the outlet 26*a*. In addition, a large amount of the liquid can flow in the second concave portion 29A. Accordingly, the liquid is further stirred, and thus it is possible to suppress sedimentation of foreign matter or components in the liquid.

When the second concave portion 29A of this embodiment and the first concave portion 28A of Embodiment 2 are used in combination, the liquid in the pressure adjustment chamber 23 is further stirred. As a result, it is possible to suppress sedimentation of foreign matter or components in the liquid.

Other Embodiments

Hereinbefore, the embodiments of the invention are described. However, the basic configuration of the invention is not limited to those described above.

Figure 10:
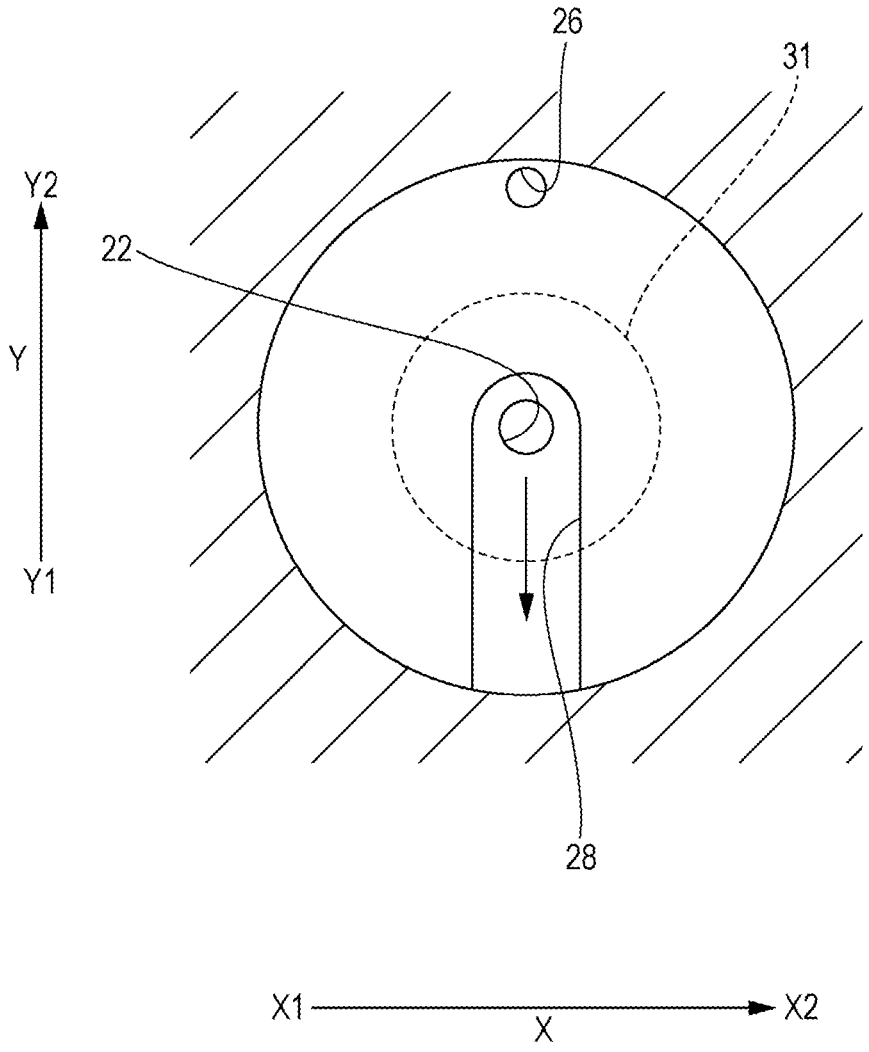
FIG. 10 is a view illustrating a principal portion of a valve unit according to an embodiment of the invention.

In Embodiments 1 to 3 described above, both the first concave portion 28 or 28A and the second concave portion 29 or 29A are provided. However, without being limited thereto, only the first concave portion 28 or 28A may be provided. Here, an example described above is illustrated in FIG. 10. FIG. 10 is a plan view illustrating a pressure adjustment chamber of a valve unit according to another embodiment of the invention. In the pressure adjustment chamber 23, only the first concave portion 28 having the same configuration as that in Embodiment 1 is formed by the wall portion 27, as illustrated in FIG. 10. In other words, the second concave portion 29 is not formed. Even in this configuration, since the first concave portion 28 is provided, a flow flowing from the inlet 22 to the side opposite to the outlet 26*a* can be formed. Therefore, the liquid flow can be formed in the area in which the liquid is most likely to stagnate. As a result, stagnation of the liquid is suppressed, and thus it is possible to suppress sedimentation of foreign matter or components in the liquid.

In Embodiments 1 to 3 described above, both the first spring 41 and the second spring 40 are provided as a spring. However, without being limited thereto, only one of the first spring 41 and the second spring 40 may be provided as a spring, as long as it can urge the valve body 50 to the Z2 side.

In Embodiments 1 to 3 described above, the spring holder 32 is provided in the pressure receiving plate 31. However, without being limited thereto, the spring holder 32 may not be provided in the pressure receiving plate 31, as long as the spring can urge the valve body 50 to the Z2 side. When the spring holder 32 is provided in the pressure receiving plate 31, the pressure receiving plate 31 can be stably connected with the spring urging the pressure receiving plate 31.

In Embodiments 1 to 3 described above, when seen in a plan view in the Z direction, the wall portion 27 has a size adequate to extend to the outside of the pressure receiving plate 31. However, the size is not limited thereto. When seen in a plan view in the Z direction, the wall portion 27 may has a size capable of being covered by the pressure receiving plate 31 and each of the wall portion 27 and the first concave portion 28 may be constituted by only a portion which is formed in an area facing the pressure receiving plate 31. In this case, the second concave portion 29 may include both a portion which is formed in an area facing the pressure receiving plate 31 and a portion which is formed in an area not facing the pressure receiving plate 31.

Figure 11A:
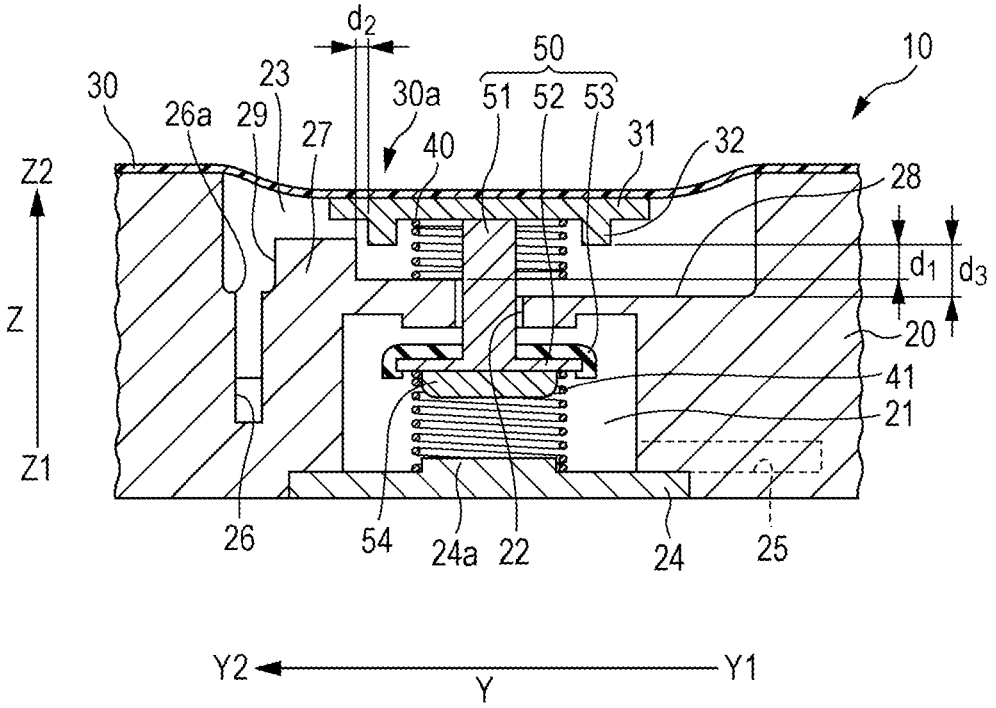
FIGS. 11A and 11B are cross-sectional views of a valve unit according to an embodiment of the invention.
Figure 11B:
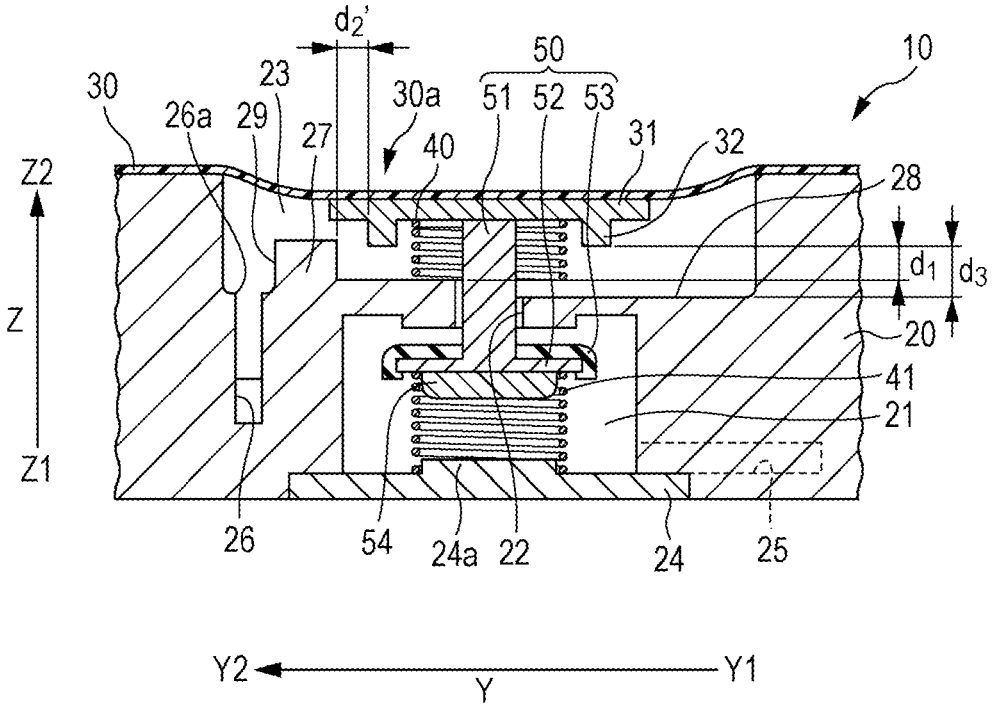

In Embodiments 1 to 3 described above, since the gap $d_2$ between the spring holder 32 and the wall portion 27 in the Y direction is set to be smaller than the gap $d_1$ between the spring holder 32 and the first concave portion 28 in the Z direction, a large amount of the liquid which flows into the pressure adjustment chamber 23 through the inlet 22 flows to the portion between the first concave portion 28 and the pressure receiving plate 31, which has a relatively low flow path resistance. However, the configuration is not limited thereto. Instead of this configuration or in addition to this configuration, the first concave portion 28 may be formed in a bottom surface of the pressure adjustment chamber 23, such that a Y1 side gap between the spring holder 32 and the first concave portion 28 in the Z direction is larger than a Y2 side gap between the spring holder 32 and the first concave portion 28. Here, the configuration described above is illustrated in FIGS. 11A and 11B. FIGS. 11A and 11B are cross-sectional views of a valve unit according to another embodiment of the invention.

In the first concave portion 28, the depth of a Y1 side portion is deeper than the depth of a Y2 side portion, with the inlet 22 as a center, as illustrated in FIG. 11A. Therefore, in the first concave portion 28, the Y1 side gap $d_3$ between the spring holder 32 and the first concave portion 28 in the Z direction can be set to be larger than the Y2 side gap $d_1$ therebetween. Accordingly, the flow path resistance of the Y1 side portion between the spring holder 32 and the first concave portion 28 is reduced, and thus a further larger amount of the liquid flowing into the pressure adjustment chamber 23 can flow to the Y1 side portion between the first concave portion 28 and the pressure receiving plate 31.

Even when a gap $d_2'$ between the spring holder 32 and the wall portion 27 in the Y direction is equal to or larger than the gap $d_1$ between the spring holder 32 and the first concave portion 28 in the Z direction in the Y2 side of the first concave portion 28, as illustrated in FIG. 11B, the depth of the Y1 side portion of the first concave portion 28 is deeper than the depth of the Y2 side portion thereof, with the inlet 22 as a center. Therefore, in the first concave portion 28, the Y2 side gap $d_3$ between the spring holder 32 and the first concave portion 28 in the Z direction can be set to be larger than the gap $d_2'$ between the spring holder 32 and the wall portion 27 in the Y direction. Accordingly, the flow path resistance of the Y2 side portion between the spring holder 32 and the first concave portion 28 is reduced, and thus a large amount of the liquid flowing into the pressure adjustment chamber 23 can flow to the Y2 side portion between the first concave portion 28 and the pressure receiving plate 31.

In Embodiments 1 to 3 described above, when seen in a plan view in the Z direction, the wall portion 27, the first concave portion 28, and the second concave portion 29 have a shape line-symmetric with respect to an axis extending in the Y direction. Therefore, the liquid flow flowing from the first concave portion 28 to the second concave portion 29 can reduce stagnation in both the X1 side and the X2 side. However, without being limited thereto, the wall portion 27 may have an asymmetric shape, for example. Needless to say, the pressure adjustment chamber 23 may have a shape asymmetric with respect to an axis extending in the Y direction.

The invention is intended to be applied to a general liquid ejecting apparatus having a liquid ejecting head. The invention can be applied to, for example, a recording head, such as various types of an ink jet type recording head, which is used in an image recording apparatus, such as a printer, a coloring material ejecting head used to manufacture a color filter for a liquid crystal display or the like, an electrode material ejecting head used to form an electrode for an organic EL display, a field emission display (FED) or the like, and a bio-organic material ejecting head used to manufacture a biochip.

The invention is not limited to a valve unit which is intended to be mounted on a liquid ejecting apparatus but can be applied to a general apparatus having a flow path.

What is claimed is:

1. A valve unit which opens/closes a flow path, comprising:

a unit main body which has a pressure adjustment chamber formed therein;

a film which seals an opening of the pressure adjustment chamber;

a pressure receiving plate which is adhered to the film;

a valve body which is connected to the pressure receiving plate; and a first spring which urges the valve body to the film, wherein the pressure adjustment chamber has an inlet through which liquid flows in, an outlet through which the liquid is discharged, a wall portion which is provided in an area facing the pressure receiving plate, and a first concave portion which is provided in an area facing the pressure receiving plate, wherein the valve body opens/closes the inlet, wherein the inlet is provided in the first concave portion, wherein a gap between the wall portion and the pressure receiving plate in a movement axis direction of the valve body is smaller than a gap between the first concave portion and the pressure receiving plate, wherein, when seen in a plan view in the movement axis direction of the valve body, the wall portion is arranged in a state where the first concave portion extends from the inlet to a side opposite to outlet side, with respect to the inlet, and wherein, the pressure receiving plate is configured to move toward the wall portion such that the pressure receiving plate abuts on the wall portion.

2. The valve unit according to claim 1, wherein the pressure adjustment chamber has a second concave portion, wherein the outlet is provided in the second concave portion, and wherein the wall portion is provided in a state where the second concave portion communicates with the first concave portion and extends along an opening edge portion of the pressure adjustment chamber.

3. The valve unit according to claim 1, wherein, when seen in a plan view in the movement axis direction of the valve body, the first concave portion is provided in a state where an opening width in a direction perpendicular to a straight line passing through the inlet and the outlet is gradually reduced, as moving from the outlet side to inlet side in the first concave portion.

4. The valve unit according to claim 1, wherein, when seen in a plan view in the movement axis direction of the valve body, the wall portion extends over the pressure receiving plate to outside of the pressure receiving plate.

5. The valve unit according to claim 1, wherein a spring holder is provided in the pressure receiving plate to accommodate one end portion of a second spring, and wherein, when the pressure receiving plate does not abut on the wall portion, a gap between the first concave portion and the spring holder in the movement axis direction of the valve body is larger than a gap between the wall portion and the spring holder in a linear direction passing through the inlet and the outlet.

6. The valve unit according to claim 1, wherein, when seen in a plan view in the movement axis direction of the valve body, the wall portion has a shape line-symmetric with respect to a straight line, as a symmetry axis, passing through the inlet and the outlet.

7. The valve unit according to claim 1, wherein the film is arranged in a state where a plane direction of the film is parallel to a vertical direction and the outlet is disposed on an upper side of the inlet in the vertical direction.

8. A liquid ejecting apparatus comprising:

the valve unit according to claim 1; and a liquid ejecting head which ejects liquid supplied through the valve unit.

9. A liquid ejecting apparatus comprising:

the valve unit according to claim 2; and a liquid ejecting head which ejects liquid supplied through the valve unit.

10. A liquid ejecting apparatus comprising:

the valve unit according to claim 3; and a liquid ejecting head which ejects liquid supplied through the valve unit.

11. A liquid ejecting apparatus comprising:

the valve unit according to claim 4; and a liquid ejecting head which ejects liquid supplied through the valve unit.

12. A liquid ejecting apparatus comprising:

the valve unit according to claim 5; and a liquid ejecting head which ejects liquid supplied through the valve unit.

13. A liquid ejecting apparatus comprising:

the valve unit according to claim 6; and a liquid ejecting head which ejects liquid supplied through the valve unit.

14. A liquid ejecting apparatus comprising:

the valve unit according to claim 7; and a liquid ejecting head which ejects liquid supplied through the valve unit.

15. The valve unit according to claim 2, wherein the second concave portion does not overlap the pressure receiving plate in the plan view.

16. The valve unit according to claim 1, wherein a spring holder is provided in the pressure receiving plate to accommodate one end portion of a second spring, and the wall portion overlaps with the pressure receiving plate in the plan view.

* * * * *